US005661884A

United States Patent [19]

Thomas

[11] Patent Number: 5,661,884

[45] Date of Patent: Sep. 2, 1997

[54] OFFSET HIGH-PRESSURE WATER DESCALING SYSTEM

[75] Inventor: John E. Thomas, Pittsburgh, Pa.

[73] Assignee: Tippins Incorporated, Pittsburgh, Pa.

[21] Appl. No.: 603,326

[22] Filed: Feb. 20, 1996

[51] Int. Cl.[6] ..... B21B 45/04; B08B 3/02

[52] U.S. Cl. ..... 29/81.08; 29/81.01; 72/40

[58] Field of Search ..... 29/81.06, 81.08, 29/81.01; 72/40; 134/64 R, 15, 2; 266/113

[56] References Cited

U.S. PATENT DOCUMENTS

| | | | |
|---|---|---|---|
| 2,197,022 | 4/1940 | Petterson | 29/81.08 |
| 3,511,250 | 5/1970 | Gallucci et al. . | |
| 3,779,054 | 12/1973 | Greenberger | 72/13 |
| 3,905,216 | 9/1975 | Hinrichsen | 72/13 |
| 4,074,555 | 2/1978 | Noé | 72/128 |
| 4,175,412 | 11/1979 | Bernot | 72/40 |
| 4,371,149 | 2/1983 | Takeuchi et al. | 266/113 |
| 4,918,959 | 4/1990 | Parazak et al. | 72/39 |
| 5,009,396 | 4/1991 | den Hartog et al. | 266/115 |
| 5,036,689 | 8/1991 | Sekiya et al. | 72/39 |
| 5,085,066 | 2/1992 | Komami et al. | 72/13 |
| 5,219,114 | 6/1993 | Kajiwara et al. | 228/158 |
| 5,235,840 | 8/1993 | Blazevic | 72/201 |
| 5,272,798 | 12/1993 | Cole et al. | 29/81.08 |
| 5,329,688 | 7/1994 | Arvedi et al. | 29/527.7 |
| 5,361,788 | 11/1994 | Cole et al. | 134/64 R |
| 5,378,308 | 1/1995 | Thoms | 134/64 R |
| 5,388,602 | 2/1995 | Coassin et al. | 266/113 |
| 5,502,881 | 4/1996 | Gaydoul . | |
| 5,505,786 | 4/1996 | Cole et al. | 134/2 |

*Primary Examiner*—S. Thomas Hughes
*Assistant Examiner*—Tisa L. Stewart
*Attorney, Agent, or Firm*—Webb Ziesenheim Bruening Logsdon Orkin & Hanson, P.C.

[57] ABSTRACT

The present invention provides a descaling system for hot strip or plate mills. The descaling system includes upper and lower spray headers which are offset from each other along the pass line. Each spray header is adapted to direct a high-pressure water spray on the metal product to descale the upper or lower surface thereof. The upper and lower spray headers are offset at a distance greater than the length of the product, whereby the spray headers can be sequentially, separately used. The spray headers are coupled to a common drive pump.

19 Claims, 1 Drawing Sheet

OFFSET HIGH-PRESSURE WATER DESCALING SYSTEM

BACKGROUND OF THE INVENTION

1. Field of the Invention

The present invention relates to descaling devices. More specifically, the present invention relates to high-pressure fluid descaling systems for hot strip or plate mills.

2. Prior Art

Large varieties of descaling systems have been utilized in the production of metal strip or plate products. Examples of different descaling systems are disclosed in U.S. Pat. Nos. 4,918,959; 5,036,689 and 5,272,798. One of the most common methods of descaling metal strip or plate is to propel high-velocity pressurized fluid, most commonly water, onto the surface area of the product in order to remove iron oxide buildup on the surface.

The high-pressure fluid descalers can be utilized at a variety of locations along the pass line in a continuous mill as shown in U.S. Pat. No. 5,235,840. Additionally, the high-pressure fluid descalers can be used in various locations along a hot reversing mill and in other positions along the pass lines of other hot strip mills.

Heretofore, high-pressure descalers were comprised of spray headers extending across the top and bottom of the strip which simultaneously direct high-pressure spray toward the metal product. The spray headers require a significant volume of descaling fluid to achieve the high impact required for sufficient descaling of the product. This volume requirement creates a very large load for the pump which simultaneously supplies the upper and lower headers.

It is an object of the present invention to provide a descaling system for a hot strip or plate mill which minimizes the energy requirements of the pump while maintaining appropriate flow to the upper and lower spray headers.

SUMMARY OF THE INVENTION

The objects of the present invention are achieved by providing a descaling apparatus for a hot strip or plate mill having a first spray header positioned above or below the pass line of the mill at a first position with the spray header adapted to direct high-pressure descaling fluid against a first surface of the metal product. A second spray header is positioned on the side of the pass line opposite the first spray header at a second position spaced along the pass line from the first position of the first spray header. The second spray header is adapted to direct high-pressure descaling fluid against a second surface of the metal product which is opposite the first surface of the metal product descaled by the first spray header. A fluid pump is coupled to the first and second spray headers with the fluid pump adapted to sequentially supply high-pressure descaling fluid to the first and second spray headers.

The second spray header is spaced from the first spray header at a distance greater than the length of the metal product, thereby assuring that sequential operation of the first and second spray headers will descale the entire metal product as the metal product passes along the pass line.

The present invention is particularly well adapted for descaling of metal plate. The descaling apparatus of the present invention can provide a single fluid pump of about 5,000 horsepower which will supply an average specific impact for the first and second descaling sprays of about 125 pounds per square inch when operated sequentially. The total flow rate of each header will be approximately 2,550 gallons per minute for each spray header having a maximum spray coverage of about 138 inches. This will allow the descaling of large metal slabs or plates which generally do not exceed 120 inches wide.

The descaling of the apparatus of the present invention provides for a method of descaling metal product which is passed along a pass line comprising the steps of supplying descaling fluid to a first descaler from the single fluid supply pump with the first descaler positioned at the first position along the pass line. A first surface of the metal product is impinged with a high-pressure descaling spray from the first descaler. Subsequent to the impinging of the first surface, the descaling fluid is supplied to a second descaler from the single fluid source pump. The second descaler is positioned at the second position along the pass line spaced from the first position. A second surface of the product is impinged with high-pressure descaling spray from the second descaler. The second position is spaced from the first position at a distance greater than the length along a pass line of the product. The steps of supplying fluid to the second descaler and impinging the second surface begin after the impingement of the first surface of the product is completed. The method of the present invention is particularly well adapted for descaling of metal plate products while the metal plate product is continuously passed along the pass line throughout the descaling method.

These and other objects of the present invention will be clarified in the description of the preferred embodiment taken together with the attached figures.

BRIEF DESCRIPTION OF THE PREFERRED EMBODIMENT

Figure 1:
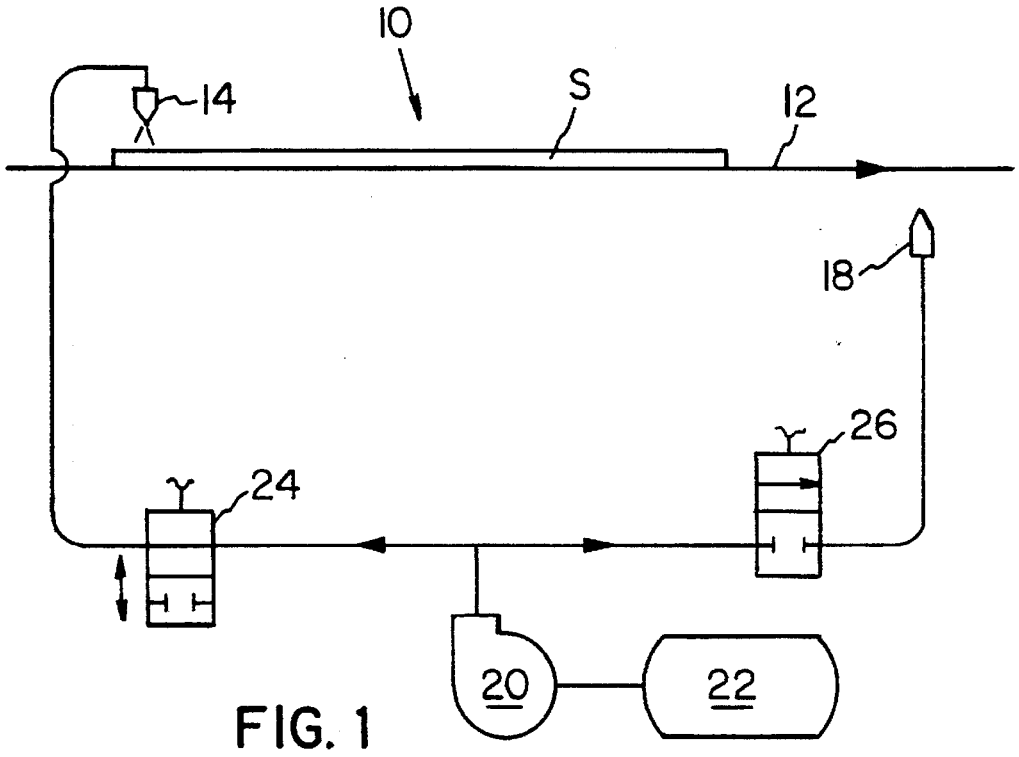
FIG. 1 is a schematic illustration of the offset high-pressure water descaling apparatus according to the present invention.

FIG. 1 schematically illustrates the offset high-pressure water descaler 10 positioned along the pass line 12 of a hot strip or plate mill according to the present invention. The descaler 10 may be positioned, for example, at the exit of a roughing mill prior to entrance into a continuous or reversing-type finishing mill. The descaler 10 may also be positioned downstream of a finishing mill or in various locations throughout a mill.

The descaler 10 includes an upper spray header 14 positioned above the pass line 12 at a first position along the pass line 12.

Figure 2A:
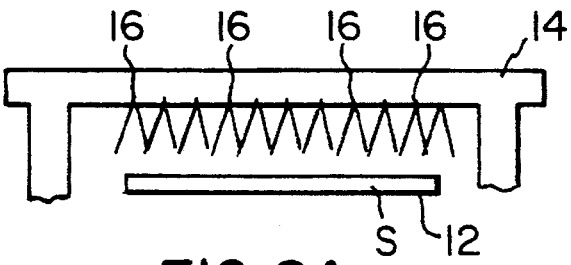
FIGS. 2A and 2B are schematic illustrations of the top and bottom spray headers of the offset high-pressure water descaler apparatus illustrated in FIG. 1.
Figure 3:
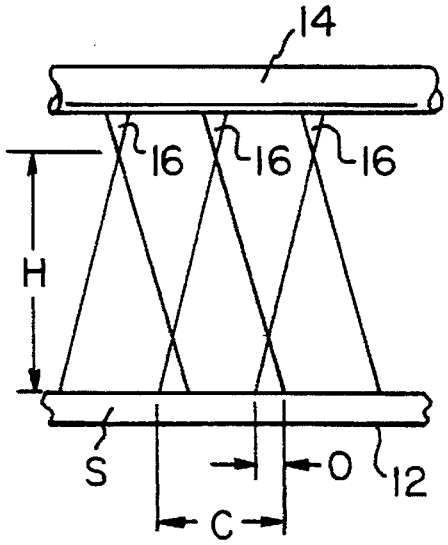
FIG. 3 is a schematic illustration of the spray coverage of a portion of the spray header illustrated in FIG. 2A.
Figure 2B:
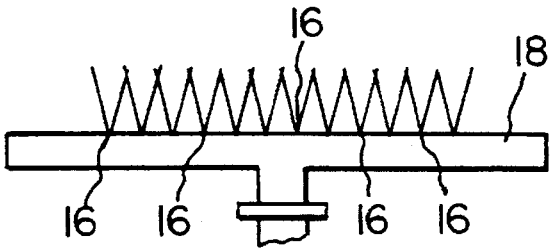

As shown in FIG. 2A, the spray header extends across the width of the pass line 12 at a distance of about 136 inches. As shown in FIGS. 2B and 3, the upper spray header 14 includes a plurality of conventional nozzles 16 at spaced locations across the spray header 14 adapted to direct high-pressure water toward the surface of the metal product. Preferably, the upper spray header 14 is formed of a 10-inch diameter pipe with the nozzles 16 spaced between 2 and 2⅛ inches away from each other having a nozzle exit height H of approximately 6 inches above the surface of the metal product S, such as a metal plate, to be descaled. As shown in FIG. 3, this arrangement will provide an overlapping descaling spray with each nozzle 16 having a spray width C of about 2½ inches and an overlap O of about ⅜ inch with the spray of an adjacent nozzle 16. The spray header is specifically designed to have a volume capacity of 2,550 gallons per minute to provide an average specific impact of 125 pounds per square inch at the surface of the product S. This should be sufficient for descaling of conventional metal strip or plate products. With this configuration, the total spray coverage of the upper header will be 138.5 inches which is sufficient for covering the general maximum metal slab width of 120 inches. Each nozzle 16 may be provided with a conventional nozzle offset of about 15°.

The descaler 10 additionally includes a lower spray header 18 on an underside of the pass line 12 at a position spaced from the upper spray header 14 at a distance greater than the length of the metal product S. As shown in FIG. 2B, the lower spray header 18 includes a plurality of nozzles 16 extending across the length of the pass line 12. The lower spray header 18 has the same flow rate and number of nozzles 16, including size and positioning of the nozzles 16, as the upper spray header 14 discussed above.

The upper spray header 14 and lower spray header 18 are coupled to a fluid pump 20 which, in turn, is coupled to the hot mill water supply 22. Fast actuating valves 24 and 26 are positioned between the fluid pump 20 and the upper spray header 14 and lower spray header 18, respectively. The valves 24 and 26 allow for sequential operation of the upper spray header 14 and lower spray header 18 as will be discussed hereinafter.

Each spray header operates at about 2,550 gallons per minute which, assuming 80% efficiency, equates to a 4,700 horsepower motor for the fluid pump 20 for each spray header 14 and 18 when operated individually. The present invention provides a 5,000 horsepower motor for the fluid pump 20. The offset and sequential operation of the upper spray header 14 and lower spray header 18 provide unique advantages to the descaler 10 of the present invention. As known in the art, the impact of a spray header on a metal product will increase as a function of the square of the volume through the spray header. Consequently, if the fluid pump 20 were utilized to simultaneously supply high-pressure descaling fluid to both the upper spray header 14 and the lower spray header 18, the descaler fluid volume to each spray header would be cut in half, and the resulting impact on the strip band would be cut by a factor of four. This would be unacceptable for descaling of conventional metal strip or plate products. However, the offset and sequential operation of the spray headers 14 and 18 allow the single fluid pump 20 to sequentially supply both the upper spray header 14 and the lower spray header 18.

The method for descaling a metal product S passing along the pass line 12 with the descaler 10 is as follows. As the metal product approaches the upper spray header 14, valve 26 remains closed and valve 24 is moved to the open position to supply descaling water to the upper spray header 14. The upper spray header 14 will impinge the upper surface of the metal product S with the high-pressure water descaling spray as the product S passes along the pass line 12. As discussed above, the upper spray header 14 is spaced from the lower spray header 18 at a distance greater than the length of the product S, whereby the upper spray header 14 will complete the descaling of the upper surface of the product S before the leading edge of the product S reaches the lower spray header 18. After the upper spray header 14 has completed descaling of the upper surface of the product S, valve 24 is closed and valve 26 will be opened to begin descaling of the lower surface of the product S as the product S passes along the pass line 12. After the lower spray header 18 has completed descaling the lower surface of the product S, valve 26 can be closed.

The sequential operation of the upper spray header 14 and lower spray header 18 provides significant cost savings to the descaler 10 of the present invention. The descaler 10 of the present invention is particularly well adapted for operating on metal plate products which can easily accommodate the offset required between the upper spray header 14 and lower spray header 18 along the roller table of the pass line 12. The specific offset between the upper spray header 14 and lower spray header 18 is a function of both the anticipated product mix for the mill and where the descaler 10 is positioned within the mill (i.e., the farther upstream the descaler is positioned in the mill, the less the offset becomes).

It will be understood by those of ordinary skill in the art that various modifications may be made to the present invention without departing from the spirit and scope thereof. .Consequently, the scope of the present invention is intended to be defined by the attached claims.

What is claimed is:

1. A method of descaling metal product in a hot strip or plate mill, said method comprising the steps of:

passing said metal product along a pass line;

descaling a first surface of said metal product using a first descaling means; and sequentially descaling a second surface of said metal product which is opposed from said first surface using a second descaling means, wherein said first descaling means and said second descaling means act by impinging a descaling substance against the surface of said metal product, wherein action of said first descaling means alternates with action of said second descaling means such that only one of said first and second descaling means is operational at a time.

2. A method of descaling a metal product in a hot strip or plate mill, said method comprising the steps of:

passing said metal product along a pass line;

descaling a first surface of said metal product by a first descaling means positioned at a first position along said pass line; and sequentially descaling a second surface of said metal product which is opposed from said first surface by a second descaling means positioned at a second position along said pass line, wherein said second position is spaced from said first position along said pass line at a distance greater than a length of said metal product.

3. The descaling method of claim 2 wherein said first descaling means impinges a descaling fluid against said first surface through a spray header positioned at said first position along said pass line.

4. The descaling method of claim 2 wherein said second descaling means impinges a descaling fluid against said second surface through a second spray header positioned at said second position along said pass line.

5. A method of descaling a metal product in a hot strip or plate mill, said method comprising the steps of:

passing said metal product along a pass line;

descaling a first surface of said metal product by a first spray header positioned at a first position along said pass line; and sequentially descaling a second surface of said metal product which is opposed from said first surface by a second spray header positioned at a second position along said pass line, wherein said first spray header and said second spray header descale said metal product by impinging a descaling fluid against said first and second surfaces, respectively, and wherein said second position is spaced from said first position along said pass line at a distance greater than a length of said metal product.

6. The descaling method of claim 5 wherein said metal product is metal plate.

7. A method for descaling a metal product passing along a pass line, said method comprising the steps of:

a) supplying descaling fluid to a first descaling means from a fluid supply pump, said first descaling means positioned at a first position along said pass line;

b) impinging a first surface of said metal product with a high-pressure descaling spray form said first descaling means at said first position along said pass line;

c) supplying descaling fluid to a second descaling means from said fluid supply pump, said second descaling means positioned at a second position along said pass line and;

d) impinging a second surface of said metal product which is opposed from said first surface with a high-pressure descaling spray from said second descaling means at said second position along said pass line, wherein said second position is spaced from said first position at a distance greater than a length of the metal product.

8. The descaling method of claim 7 wherein said steps of supplying fluid to said second descaling means and of impinging said second surface begin after said impinging of said metal first surface is completed for said product.

9. The descaling method of claim 8 wherein said product metal is a metal plate.

10. The descaling method of claim 9 further including the step of passing said metal plate along said pass line throughout said descaling process.

11. The descaling method of claim 10 wherein an average specific impact of said high-pressure descaling spray is about 125 pounds per square inch.

12. The descaling method of claim 11 wherein said fluid supply pump is a 5,000 horsepower pump.

13. A descaling apparatus for descaling metal product in a hot strip or plate mill, said descaling apparatus comprising:

a first spray header positioned on a first side of a pass line of said mill at a first position along said pass line, said first spray header adapted to direct high-pressure descaling fluid against a first surface of the metal product;

a second spray header positioned on a second side of said pass line opposite said first side, said second spray header positioned at a second position along said pass line spaced from said first position, said second spray header adapted to direct high-pressure descaling fluid against a second surface of the metal product which is opposite the first surface;

a fluid pump coupled to said first and second spray headers; and a sequencing means for directing the high-pressure descaling fluid from said fluid pump alternately to said first spray header and said second spray header.

14. The apparatus of claim 13 wherein said sequencing means includes an actuating valve positioned between each of said first and second spray headers and said fluid pump.

15. A descaling apparatus for descaling metal product in a hot strip or plate mill, said descaling apparatus comprising:

a first spray header positioned on a first side of a pass line of said mill at a first position along said pass line, said first spray header adapted to direct high-pressure descaling fluid against a first surface of the metal product;

a second spray header positioned on a second side of said pass line opposite said first side, said second spray header positioned at a second position along said pass line spaced from said first position, said second spray header adapted to direct high-pressure descaling fluid against a second surface of the metal product which is opposite the first surface; and a fluid pump coupled to said first and second spray headers, said fluid pump adapted to sequentially supply high-pressure descaling fluid to said first and second spray headers;

wherein said second position of said second spray header is spaced from said first position of said first spray header along said pass line at a distance greater than a length of the metal product.

16. The descaling apparatus of claim 15 wherein said spray first header is positioned above said pass line and said second spray header is positioned below said pass line.

17. The descaling apparatus of claim 16 wherein said fluid pump is about 5,000 horsepower.

18. The descaling apparatus of claim 17 wherein an average specific impact of a descaling spray from said first and second spray headers is about 125 pounds per square inch.

19. The apparatus of claim 18 wherein said first and second spray headers includes a plurality of adjacent nozzles arranged across a width of said product on said pass line.

* * * * *

UNITED STATES PATENT AND TRADEMARK OFFICE

CERTIFICATE OF CORRECTION

PATENT NO. : 5,661,884

DATED : September 2, 1997

INVENTOR(S) : John E. Thomas

It is certified that error appears in the above-indentified patent and that said Letters Patent is hereby corrected as shown below:

Column 4 Line 20 "thereof. .Consequently" should read --thereof. Consequently--.

Claim 6 Column 5 Line 9 after "is" insert --a--.

Claim 8 Column 5 Line 33 after "said" first occurrence delete --metal--
and

Claim 9 Column 5 Lines 34-35 "product metal" should read --metal product--.

Claim 16 Column 6 Line 39 "spray first" should read --first spray--.

Signed and Sealed this

Twelfth Day of May, 1998

*Attest:*

*Attesting Officer*

BRUCE LEHMAN

*Commissioner of Patents and Trademarks*